US005575864A

United States Patent [19]

Haley et al.

[11] Patent Number: 5,575,864

[45] Date of Patent: Nov. 19, 1996

[54] METHOD FOR CLEANING A HARD SURFACE WITH AN ALL-PURPOSE LIQUID CLEANING COMPOSITION

[76] Inventors: Kalliopi S. Haley, 8606 Woodruff Dr., Byron Center, Mich. 49315; Jeffrey J. Fisher, 3936 Summitview, NE., Grand Rapids, Mich. 49505

[21] Appl. No.: 464,970

[22] Filed: Jun. 5, 1995

Related U.S. Application Data

[62] Division of Ser. No. 216,682, Mar. 23, 1994, abandoned.

[51] Int. Cl.[6] ..... B08B 3/04; B08B 3/08

[52] U.S. Cl. ..... 134/42; 510/405; 510/422; 510/424; 510/427; 510/432; 510/470; 510/488; 510/506

[58] Field of Search ..... 134/42, 6, 22.14, 134/22.19; 252/170, 171, 550, 553, 174, 174.23

[56] References Cited

U.S. PATENT DOCUMENTS

| | | | |
|---|---|---|---|
| 3,882,038 | 5/1975 | Clayton et al. | 252/89 |
| 4,338,211 | 7/1982 | Stiros | 252/142 |
| 4,483,779 | 11/1984 | Llenado et al. | 252/135 |
| 4,483,780 | 11/1984 | Llenado | 252/135 |
| 4,488,981 | 12/1984 | Urfer et al. | 252/174.17 |
| 4,627,931 | 12/1986 | Malik | 252/153 |
| 4,663,069 | 5/1987 | Llenado | 252/117 |
| 4,732,704 | 3/1988 | Biermann et al. | 252/548 |
| 5,025,069 | 6/1991 | Deguchi et al. | 252/174.17 |
| 5,035,814 | 7/1991 | Maaser | 252/8.7 |
| 5,073,293 | 12/1991 | Deguchi et al. | 252/174.17 |
| 5,077,039 | 12/1991 | Baur et al. | 424/70 |
| 5,100,573 | 3/1992 | Balzer | 252/174.17 |
| 5,154,850 | 10/1992 | Deguchi et al. | 252/174.17 |
| 5,205,959 | 9/1993 | Schmid et al. | 252/174.12 |
| 5,230,823 | 7/1993 | Wise et al. | 252/174.21 |
| 5,230,835 | 7/1993 | Deguchi et al. | 252/550 |
| 5,234,618 | 8/1993 | Kamegai et al. | 252/106 |
| 5,350,541 | 9/1994 | Michael et al. | 252/549 |
| 5,376,298 | 12/1994 | Michael | 252/153 |

FOREIGN PATENT DOCUMENTS

| | | |
|---|---|---|
| 589585 | 7/1986 | Australia . |
| 42818/89 | 4/1990 | Australia . |
| 59480/94 | 10/1994 | Australia . |
| 60512/94 | 10/1994 | Australia . |
| 070074 | 1/1983 | European Pat. Off. . |
| 216301 | 9/1986 | European Pat. Off. . |
| 210220 | 2/1987 | European Pat. Off. . |
| 268064 | 10/1987 | European Pat. Off. . |
| 261874 | 3/1988 | European Pat. Off. . |
| 0347110 | 12/1989 | European Pat. Off. . |
| 344847 | 12/1989 | European Pat. Off. . |
| 347110 | 12/1989 | European Pat. Off. . |
| 374702 | 6/1990 | European Pat. Off. . |
| 384983 | 9/1990 | European Pat. Off. . |
| 399752 | 11/1990 | European Pat. Off. . |
| 402981 | 12/1990 | European Pat. Off. . |
| 408965 | 1/1991 | European Pat. Off. . |
| 426876 | 5/1991 | European Pat. Off. . |
| 491531 | 6/1992 | European Pat. Off. . |
| 509608 | 10/1992 | European Pat. Off. . |
| 510870 | 10/1992 | European Pat. Off. . |
| 595383 | 5/1994 | European Pat. Off. . |
| 2134132 | 8/1984 | United Kingdom . |
| WO90/05772 | 5/1990 | WIPO . |
| WO93/00417 | 1/1993 | WIPO . |
| WO93/23511 | 11/1993 | WIPO . |
| WO93/25650 | 12/1993 | WIPO . |
| WO93/25654 | 12/1993 | WIPO . |
| WO94/07977 | 4/1994 | WIPO . |
| WO94/07982 | 4/1994 | WIPO . |
| WO94/14944 | 7/1994 | WIPO . |

*Primary Examiner*—Zeinab El-Arini

[57] ABSTRACT

A method for cleaning a hard surface with concentrated all-purpose liquid cleaning compositions that contain high levels of surfactants and solvents and which exhibit improved cleaning performance and homogeneity in solution. A preferred formulation incorporates an actives systems of a three component mixture: an anionic surfactant such as alkyl ethoxy sulfates, alkyl ethoxy carboxylates and mixtures thereof, a nonionic surfactant such as fatty alcohol ethoxylates, nonylphenol ethoxylates, alkylpolyglycosides and mixtures thereof, a glycol ether solvent and optional ingredients to provide a concentrated cleaning composition which can be diluted to the desired strength.

8 Claims, No Drawings

METHOD FOR CLEANING A HARD SURFACE WITH AN ALL-PURPOSE LIQUID CLEANING COMPOSITION

This is a divisional of application Ser. No. 08/216,682, filed on Mar. 23, 1994, now abandoned.

BACKGROUND OF THE INVENTION

The present invention is directed to concentrated light duty all-purpose liquid cleaning compositions, more particularly to concentrated light duty all-purpose spray and wipe liquid cleaning compositions which can be diluted by the end user to the end user's preferred strength. A method for using such compositions is also disclosed.

The compositions of the present invention and the method of use relate to the specialized class of concentrated cleaning products which are designed to be used as is or diluted by the end user to a preferred strength for the particular job at hand. Such concentrated cleaning compositions can be applied from any type of hand-operated sprayer or from a bucket dilution, and more preferably can be applied from a hand-held sprayer which dilutes the product in a ratio acceptable to the end user such as that shown in U.S. Pat. No. 5,152,461 and patent application Ser. No. 07/865,001; both of which are hereby incorporated by reference.

There has long been a desire to produce concentrated cleaners for consumer use. Concentrated cleaners provide high strength cleaning for difficult soils, economical solutions when diluted and minimize packaging and transportation costs. In some cleaning applications, such as heavy duty laundry applications, concentrated formulas based on high surfactant levels are known in the art and have been prepared successfully with the use of suitable surfactants and hydrotropes. Likewise, powder formulations with high concentrations are known in the art and are typically made through the use of agglomeration or similar technology.

Similarly, light duty all-purpose cleaners are known in the art. For example, U.S. Pat. No. 5,230,823 discloses a light duty liquid cleaning composition using extremely pure alkyl ethoxy carboxylates and optionally includes a cosurfactant and a suds booster. U.S. Pat. No. 4,627,931 discloses a diluted and concentrated composition for hard surface cleaning which includes a nonionic surfactant and an organic solvent in combination with a builder. U.S. Pat. No. 3,882,038 discloses a diluted and concentrated composition containing a surfactant, a builder and glycol ether solvents. However, highly concentrated all-purpose spray and wipe cleaners which can be diluted by the end user to the end user's preferred strength are not known in the art. This is due in part to the need in a consumer product of several characteristics such as dilutability, wettability of surfaces and soils, no streaking, quick evaporation, good cleaning characteristics and the ability to meet safety standards for household products. The typical approach to these all-purpose spray and wipe cleaners is to make the product in low concentrated form with the use of moderate levels of water-soluble solvents in combination with low levels of cosurfactants and builders.

Problems often occur when attempting to produce an all-purpose spray and wipe cleaner in highly concentrated form. Solvents which evaporate quickly typically have low flash points. On increasing the concentration of these solvents, compositions with unacceptably low formula flash points are produced. Also, typically, solvents which exhibit high soil solvency tend to have lower evaporation rates which can result in products which are difficult for the consumer to use and can leave streaks on the surfaces being cleaned. Therefore, above certain solvent concentrations, it has been difficult to formulate a concentrated product which meets consumer acceptability.

One approach to the aforementioned problem has been to use builder salts in a formula with low concentrations of surfactants and solvents to thereby enhance the performance of the surfactants and solvents. This approach gives good cleaning, and because the salts are not volatile, they do not lower the flash point of the composition. However, streaking is often inherent in these compositions with builder salts and evaporation rates are slower. Builders also have significant environmental liabilities.

Another approach known in the art has been the use of solvent blends, combining higher and lower volatility solvents, to enhance evaporation and raise flash points. However, solvent blends with both high evaporation rates and high flash points often exhibit instabilities in product formulations containing surfactants and water. In particular, high solvent all-purpose cleaning systems typically suffer from a lack of homogeneity, thus requiring the consumer to extensively agitate the product prior to using in order to obtain an equal dispersion of materials.

SUMMARY OF THE INVENTION

In a first embodiment, the present invention discloses a highly concentrated all-purpose cleaning composition comprising:

(a) from about 1% to about 20% of at least one anionic surfactant, such as alkyl ethoxy sulfates, alkyl ethoxy carboxylates and mixtures thereof;

(b) from about 1% to about 20% of at least one nonionic surfactant, such as linear fatty alcohol ethoxylates, nonylphenol ethoxylates, alkylpolyglycosides and mixtures thereof;

(c) from about 5% to about 60% of a glycol ether solvent selected from at least one of the ethylene glycol monoalkyl ethers, propylene glycol monoalkyl ethers and a mixture thereof; and (d) water and other additives comprising the balance.

In a second embodiment, a method of using a highly concentrated cleaning composition is disclosed comprising the steps of diluting the cleaning composition to the end user's preferred strength, applying the cleaning composition to the area to be cleaned and wiping from the area the liquid cleaning composition.

In the compositions of the present invention, it has been surprisingly found that a highly concentrated cleaning system which exhibits dilutability, homogeneity in solution, excellent cleaning performance, fast evaporation, limited streaking and acceptable flash point can be prepared without using a builder by combining substantially high percentages of at least one anionic surfactant, at least one nonionic surfactant and a glycol ether solvent. The composition of the present invention also allows the end user to dilute the composition to the preferred strength from a hand-held sprayer or in a bucket application. It is noted that while the compositions of the present invention can be used in a variety of cleaning applications including laundry care, hard surface cleaning and dishwashing applications, the compositions of the present invention are most often used as an all-purpose light duty spray and wipe household hard surface cleaning composition.

In the description that follows, it is to be assumed that all percentages are based on the total weight of the composition.

DETAILED DESCRIPTION OF THE PREFERRED EMBODIMENT

In the first preferred embodiment, the concentrated all-purpose liquid cleaning composition comprises at least one anionic surfactant, at least one nonionic surfactant, a glycol ether solvent with water and other optional ingredients comprising the balance.

In the second preferred embodiment, the method for cleaning hard surfaces with a concentrated all-purpose cleaning composition comprises the steps of diluting the concentrated cleaning composition with water in a ratio of about 1:1 to about 1:20 cleaning composition to water in a strength acceptable to the end user, applying the liquid cleaning composition to the surface to be cleaned and wiping the liquid cleaning composition from the surface. The principle ingredients are included in the highly concentrated all-purpose liquid cleaning composition in the following percentage ranges:

| Ingredient | Preferred Range | More Preferred Range | Most Preferred Range |
|---|---|---|---|
| Anionic Surfactants | from about 1% to about 20% | from about 6% to about 16% | from about 10% to about 14% |
| Nonionic Surfactants | from about 1% to about 20% | from about 8% to about 18% | from about 13% to about 17% |
| Glycol Ether Solvent | from about 5% to about 60% | from about 25% to about 55% | from about 35% to about 45% |
| Water and Other Optional Ingredients | balance | balance | balance |

Anionic Surfactants

Anionic surfactants can be broadly described as water-soluble salts of organic reaction products having in their molecular structure an anionic solubilizing group such as the carboxylates, sulfates, sulfonates and phosphates; an alkyl radical containing from about 8 to about 22 carbon atoms; and a cationic moiety selected from the alkali metals, such as sodium or potassium, the alkaline earth metals, such as calcium and magnesium, and ammonium or substituted ammonium cations including, for example, methyl, dimethyl, trimethyl and quartenary ammonium cations. Substantially any liquid or liquefiable anionic surfactant which has been used in detergent compositions can be employed in the present invention. A comprehensive listing and discussion of anionic surfactants or detergents useful in the present invention can be found in *McCutcheon's Detergents and Emmulsifiers* 1993 Annual and in U.S. Pat. No. 3,929,678 which is incorporated herein by reference.

Preferred anionic surfactants useful in the present invention include those derived from fatty alcohol ethoxylates, and in particular those fatty alcohol ethoxylates reacted with sulfating materials or chloroacetic acid. In one embodiment of the invention, the anionic surfactant is selected from the group of alkyl ethoxy sulfates having the general formula:

$$CH_3-(CH_2)_x-CH_2-(O-CH_2-CH_2)_y-O-\overset{\overset{\displaystyle O}{\|}}{\underset{\underset{\displaystyle O}{\|}}{S}}-O^-M^+$$

Preferably, the alkyl ethoxy sulfate is selected from the group where x is from about 6 to about 14 and y is from about 1 to about 9, more preferably x is from about 10 to about 13 and y is from about 3 to about 9. Most preferably, x is from about 10 to about 13 and y is about 3. The alkyl ethoxy sulfate is present in a range of from about 1% to about 20% and more preferably is present in the range of from about 6% to about 16%. Most preferably, the alkyl ethoxy sulfate is present in a range of from about 10% to about 14% with about 11% to about 13% being optimum. $M^+$ is preferably an alkali metal ion, most preferably sodium.

In another embodiment of the invention, the anionic surfactant is selected from the group of alkyl ethoxy carboxylates having the general formula:

$$CH_3(CH_2)_x-CH_2-(O-CH_2-CH_2)_y-O-CH_2-COOM^+$$

Preferably, the alkyl ethoxy carboxylate is selected from the group where x is from about 6 to about 14 and y is from about 1 to about 9, more preferably x is from about 10 to about 13 and y is from about 3 to about 7. Most preferably, x is from about 10 to about 13 and y is 7. Preferably, $M^+$ is a hydrogen or solubilizing metal, more preferably an alkali metal such as sodium or potassium or an ammonium or lower alkanolammonium such as triethanolammonium, monoethanolammonium or diisopropanolammonium. Most preferably, $M^+$ is sodium.

Examples of alkyl ethoxy carboxylates that may be useful in the present invention include, but are not limited to, sodium buteth-3 carboxylate, sodium hexeth-4 carboxylate, sodium laureth-5 carboxylate, sodium laureth-6 carboxylate, sodium laureth-8 carboxylate, sodium laureth-11 carboxylate, sodium laureth-13 carboxylate, sodium trideceth-3 carboxylate, sodium trideceth-6 carboxylate, sodium trideceth-7 carboxylate, sodium trideceth-19 carboxylate, sodium capryleth-4 carboxylate, sodium capryleth-6 carboxylate, sodium capryleth-9 carboxylate, sodium capryleth-13 carboxylate, sodium ceteth-13 carboxylate, sodium $C_{12-15}$ pareth-6 carboxylate, sodium $C_{12-15}$ pareth-7 carboxylate, sodium $C_{14-15}$ pareth-8 carboxylate, isosteareth-6 carboxylate as well as the acid forms. Sodium $C_{12-15}$ pareth-7 carboxylate is most preferred. The most preferred sodium $C_{12-15}$ pareth-7 carboxylate has a solids percent of about 58–62, a pH in 10% aqueous solution of about 7–8.5, a solubility in water of greater than 10% and is a mixture of approximately 5–10% ethoxylated alcohol and approximately 40–60% of alkyl ethoxy carboxylate. An example of the most preferred alkyl ethoxy carboxylate is sold under the trademark SURFINE™WLG by Finetex Corporation.

The amount of alkyl ethoxy carboxylate present in the compositions preferably ranges from about 1% to about 20%, more preferably from about 6% to about 16% by weight. Most preferably, the alkyl ethoxy carboxylate is present from about 10% to about 14% with about 11% to about 13% being particularly preferred.

Nonionic Surfactants

Most commonly, nonionic surfactants are compounds produced by the condensation of an alkylene oxide (hydrophilic in nature) with an organic hydrophobic compound which is usually aliphatic or alkyl aromatic in nature. The length of the hydrophilic or polyoxyalkylene moiety which is condensed with any particular hydrophobic compound can be readily adjusted to yield a water-soluble compound having the desired degree of balance between hydrophilic and hydrophobic elements. Another variety of nonionic surfactant is the semi-polar nonionic typified by the amine oxides, phosphine oxides and sulfoxides. Substantially any liquid or liquefiable nonionic surfactant can be employed in the present invention. A comprehensive listing and discussion of nonionic surfactants can be found in *McCutcheon's Detergents and Emulsifiers* 1993 Annual and the textbook *Surface Active Agents,* Volume 2, by Schwartz, Perry and Berch (Inter. Science Publishers, 1958). Without limitation, further nonionic surfactants which can be used in the present invention are set forth in U.S. Pat. No. 3,929,678 which is incorporated herein by reference.

Examples of nonionic surfactants useful in the present invention include but are not limited to:

1. The polyethylene oxide condensates of alkyl phenols. These compounds include the condensation product of alkyl phenols having alkyl moieties from 1 to 15, preferably 4 to 12 carbon atoms in a straight chain or branched chain configuration with from 1 to 25, preferably 1 to 9 moles of ethylene oxide per mole of alkyl phenol. The alkyl substituents in such compounds can be derived, for example, from polymerized propylene, diisobutylene and the like. Examples of compounds of this type include nonylphenol condensed with about 9.5 moles of ethylene oxide per mole of nonylphenol; dodecyl phenol condensed with about 12 moles of ethylene oxide per mole of phenol; dinonylphenol condensed with about 15 moles of ethylene oxide per mole of phenol. Commercially available nonionic surfactants of this type include IGEPAL® CO-610 marketed by the GAF Corporation; and TRITON® 45, 114, 100 and 102, all marketed by Rohm and Haas Company.

2. The condensation products of aliphatic alcohols with from 1 to 25, and preferably 5 to 16 moles of ethylene oxide. The alkyl chain with the aliphatic alcohol can either be straight or branched, primary or secondary and generally contains from about 6 to 22 carbon atoms. Examples of such ethoxylated alcohols include the condensation products of myristyl alcohol condensed with about 10 moles of ethylene oxide per mole of myristyl alcohol; and the condensation product of about 9 moles of ethylene oxide with coconut alcohol (a mixture of fatty alcohols with alkyl chains varying in length from 10 to 14 carbon atoms). Examples of commercially available nonionic surfactants of this type include TERGITOL® 15-S-9 marketed by the Union Carbide Corporation, NEODOL® 23-6.5 marketed by the Shell Corporation.

3. Alkylpolysaccharides having a hydrophobic group containing from 6 to 30 carbon atoms and a polysaccharide group containing from about 1 to about 10 saccharide units. Any reducing saccharide containing 5 or 6 carbon atoms can be used, such as glucose, lactose, galactose and galactosyl moieties can substitute for the glucosyl moieties. The hydrophobic group can be attached at the 2, 3 or 4 positions, thus giving a glucose or galactose as opposed to a glucoside or a galactoside. The intersaccharide bonds can be between the 1 position of the additional saccharide units and the 2-, 3-, 4- and/or 6 positions of the preceding saccharide units. Optionally, and less desirably, there can be a polyalkylene oxide chain joining the hydrophobic moiety and the polysaccharide moiety. The preferred alkylene oxide is ethylene oxide. Typical hydrophobic groups include alkyl groups, either saturated or unsaturated, branched or unbranched, containing from about 6 to about 18, more preferably from about 8 to 16 and most preferably from about 9 to about 10 carbon atoms. Suitable alkyl polysaccharides are octyl, nonyl, decyl, undecyl, dodecyl, tridecyl, tetradecyl, pentadecyl, hexadecyl, heptadecyl and octadecyl, tri-, tetra-, penta- and hexaglucosides, galactisides, lactoses, lactosides, glucoses, fructosides, fructoses and/or galactoses. Examples of commercially available nonionic surfactants of this type include GLUCOPON™ 225CS and GLUCOPON™ 425 manufactured by Henkel Corporation.

4. The condensation products of ethylene oxide with a product resulting from the reaction of propylene oxide and ethylene diamine. The hydrophobic moiety of these products consists of the reaction product of ethylene diamine and excess propylene oxide, the moiety having a molecular weight from about 2,500 to about 3,000. This hydrophobic moiety is condensed with ethylene oxide to the extent that the condensation product contains from about 40% to about 80% by weight of polyoxyethylene and has a molecular weight from about 5,000 to about 11,000. Examples of this type of nonionic surfactant include certain of the commercially available TECTRONIC® compounds marketed by Wyandot Chemical Corporation.

5. Semi-polar nonionic detergent surfactants which include water-soluble amine oxides containing one alkyl moiety of from 10 to 18 carbon atoms and two moieties selected from the group consisting of alkyl groups and hydroxy alkyl groups containing from 1 to 3 carbon atoms; water-soluble phosphine oxides containing one alkyl moiety of from about 10 to about 18 carbon atoms and two moieties selected from the group consisting of alkyl groups and hydroxy alkyl groups containing from 1 to 3 carbon atoms; and water-soluble sulfoxides containing one alkyl moiety of from 10 to 18 carbon atoms and a moiety selected from the group consisting of alkyl and hydroxy alkyl moieties of from 1 to 3 carbon atoms.

6. The condensation products of ethylene oxide with a hydrophobic base formed by the condensation of propylene oxide with propylene glycol. The hydrophobic portion of these compounds has a molecular weight from about 1,500 to about 1,800 and exhibits water solubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation of up to about 40 moles of ethylene oxide. Examples of compounds of this type include certain of the commercially available PLURONIC® surfactants marketed by Wyandot Chemical Corporation.

7. Fatty acid amide detergent surfactants having the formula $R_7$—CO—$NR_8R_8$, wherein $R_7$ is an alkyl group containing from 7 to 21, preferably 9 to 17, carbon atoms and each $R_8$ is a hydrogen, an alkyl group having from 1 to 4 carbon atoms, hydroxy alkyl group having from 1 to 4 carbon atoms and —$(C_2H_4O)_nH$ where n is 1 to 3, and is preferably 1.

More preferred nonionic surfactants useful in the present invention include the fatty alcohol ethoxylates, nonylphenol ethoxylates, alkylpolyglycosides and mixtures thereof with the alkylpolyglycosides being most preferred. The most preferred alkylpolyglycoside useful in the present composition has the formula:

$$RO(C_MH_{2M}O)_t(glycosyl)_x$$

wherein R is selected from the group consisting of alkyl, alkyl phenol, hydroxyalkyl, hydroxyalkyl phenol and mixtures thereof in which said alkyl groups contain from about 6 to about 18 carbon atoms, more preferably from about 8 to about 16 carbon atoms and most preferably from about 9 to about 10 carbon atoms; M is 2 or 3, preferably 2; t is from 0 to 10, preferably 0; and x is from about 1 to about 5, preferably from about 1 to about 3 and most preferably from about 1.5 to about 2.7 carbohydrate units. The glycosol is preferably derived from glucose. Exemplary alkylpolyglycosides useful in the present invention are those marketed under the trademark GLUCOPON™ 225CS and GLUCOPON™ 425 manufactured by Henkel Corporation. Particularly preferred is GLUCOPON™ 225CS which has between 8 and 10 alkyl chains present, an average alkyl chain length of 9.1, HLB of 13.6, percent actives of about 65 and free fatty alcohol percent less than or equal to 1.

The nonionic surfactant is present in the range of from about 1% to about 20%, more preferably from about 8% to about 18% and most preferably from about 13% to about 17% with about 14% to about 16% being optimum. Most preferably, the nonionic surfactant present in these ranges is alkylpolyglycoside.

Solvent

The concentrated all-purpose cleaning composition of the present invention also contains a solvent in the range of from about 5% to about 60% by weight. Non-limiting examples of suitable water-soluble solvents include the highly water-soluble glycol ethers including ethylene glycol monoalkyl ethers, propylene glycol monoalkyl ethers, isopropylene glycol monoalkyl ethers, diethylene glycol monoalkyl ethers, dipropylene glycol monoalkyl ethers, tripropylene glycol monoalkyl ethers and mixtures thereof. More preferably, the solvent mixture of the present invention comprises ethylene glycol monoalkyl ethers, propylene glycol monoalkyl ethers and mixtures thereof. Most preferably, the solvent comprises at least one of ethylene glycol n-butyl ether, propylene glycol methyl ether, propylene glycol propyl ether and propylene glycol n-butyl ethers and mixtures thereof.

The glycol ether solvent is present in the actives system in a range of from about 5% to about 60%1, and more preferably in a range of from about 25% to about 55%. Most preferably, the glycol ether solvent is present in the actives system in a range of from about 35% to about 45% with 36% to 38% being optimum.

When the glycol ether solvent comprises a mixture of ethylene glycol monoalkyl ethers and propylene glycol monoalkyl ethers, preferably the solvent mixture comprises at least one of from about 5% to about 60% of ethylene glycol n-butyl ether, from about 5% to about 60% of propylene glycol methyl ether, from about 5% to about 60% of propylene glycol propyl ether, from about 1% to about 10% of propylene glycol n-butyl ether and mixtures thereof. More preferably, when the glycol ether solvent mixture comprises a mixture of ethylene and propylene glycol monoalkyl ethers, the glycol ether solvent mixture comprises from about 1% to about 30% of ethylene glycol n-butyl ether, from about 1% to about 20% of propylene glycol methyl ether, from about 1% to about 20% of propylene glycol propyl ether and from about 1% to about 10% of propylene glycol n-butyl ether. In the most preferred embodiment, ethylene glycol n-butyl ether is present in a range of from about 9% to about 12%, propylene glycol methyl ether is present in a range of from about 9% to about 12%, propylene glycol propyl ether is present in a range of from about 14% to about 16% and propylene glycol n-butyl ether is present in a range of from about 3% to about 5%. Examples of glycol ethers useful in the present invention include ethylene glycol n-butyl ether sold under the trademark DOWANOL® EB by Dow Chemical Company, propylene glycol methyl ether sold under the trademark DOWANOL® PM by Dow Chemical company, propylene glycol propyl ether sold under the trademark DOWANOL® PNP by Dow Chemical Company and propylene glycol n-butyl ether sold under the trademark DOWANOL® PNB by Dow Chemical company.

Optional Ingredients

The concentrated all-purpose cleaning composition of the present invention can be supplemented by the usual additives conventionally employed in detergent compositions including the usual adjuvants, dilutants and other surfactants, such as cationic, amphoteric and zwitterionic surfactants, dyes, perfumes, preservatives, suds regulating or suppressing agents and others without detracting from the advantageous properties of the compositions. The compositions can contain up to about 10% of these optional ingredients. It is preferred that the composition of the present invention contain from about 0% to about 1% of a dye and most preferably from about 0.001 to 0.002 of blue dye. It is most preferred that the composition contains no builder.

Water

Either treated water, such as soft or deionized, or untreated water, such as tap water, can comprise the balance of the concentrated all-purpose liquid cleaning composition. Accordingly, the compositions of the preferred embodiments can contain per 100 parts of the concentrated liquid cleaning composition from about 90% to about 0% parts water.

Methods of Manufacture

The concentrated all-purpose liquid cleaning composition of the present invention is manufactured through the standard manufacturing processes such as mixing or blending the composition and is typically prepared through the sequential addition of ingredients to the mixing vessel with low or high shear mixing provided by a turbine, propeller, impeller or the like with order of addition and temperature suitable to the specific ingredients chosen. In one example, water as necessary is added to the mix vessel, followed by the desired solvents, the desired surfactants, followed by the desired optional ingredients with continuous low speed mixing at ambient temperatures.

Use Procedures

The concentrated all-purpose liquid cleaning composition can be used by itself as a concentrated product and applied directly to the area to be cleaned or first diluted with water to the end user's preferred strength. This dilution can take place either in a bucket or other containment device or during the packaging process when being put into a spray-type cleaner. Most preferably, the dilution by the end user is in a ratio of about 1:1 to about 1:20 of cleaning composition to water and the dilution takes place in a spray cleaner application such as that found in U.S. Pat. No. 5,152,461 and patent application Ser. No. 07/865,001, both of which are herein incorporated by reference. When using this latter method, the all-purpose liquid cleaning composition is placed in its concentrated form in a bottle and attached to the sprayer device containing another bottle filled with water. The end user simply manipulates the sprayer's concentration ratio, applies the cleaning composition to the surface to be cleaned and thereafter wipes the cleaning composition from said surface.

Examples

The following examples are provided by way of explanation and description and should not be seen as limiting the scope of the invention.

In the examples that follow, the abbreviations used have the following descriptions:

SPC—Sodium pareth-7 carboxylate marketed under the trademark SURFINE™ WLG by Finetex Corporation APG—Alkylpolyglycoside marketed under the trademark GLUCOPON™ 225CS by Henkel Corporation SPS—Sodium pareth-25 sulfate marketed under the trademark NEODOL® 25-3S by Shell Chemical Corporation FAE—Fatty alcohol ethoxylate marketed under the trademark NEODOL® 1-7 by Shell Chemical Corporation Dye—Reactive blue dye 41

FRG—Fragrance $H_2O$—Water

The following liquid Compositions 1–12 were prepared by mixing the following components in a standard mixing vessel at room temperature in the order identified in Methods of Manufacture:

| | Compositions 1–7 | | | | | | |
|---|---|---|---|---|---|---|---|
| Component | 1 | 2 | 3 | 4 | 5 | 6 | 7 |
| SPC | 12.0 | 12.0 | 12.0 | 12.0 | 12.0 | 20.0 | 12.0 |
| APG | 15.0 | 15.0 | 15.0 | 15.0 | 15.0 | 20.0 | 15.0 |
| SPS | — | — | — | — | — | — | — |
| FAE | — | — | — | — | — | — | — |
| EB | 9.5 | — | 30.0 | 10.0 | 10.0 | 5.0 | 9.5 |
| PGP | 15.0 | 20.0 | — | 15.0 | 15.0 | 5.0 | 15.0 |
| PM | 10.0 | 20.0 | 10.0 | — | 10.0 | 5.0 | 10.0 |
| PNB | 3.0 | 10.0 | 10.0 | 10.0 | — | 5.0 | 3.0 |
| EDTA | — | — | — | — | — | — | 10.0 |
| NaC | — | — | — | — | — | — | — |
| NaP | — | — | — | — | — | — | — |
| Dye | — | — | — | — | — | — | — |
| FRG | — | — | — | — | — | — | — |
| $H_2O$ | 35.5 | 23.0 | 23.0 | 38.0 | 38.0 | 40.0 | 25.5 |

| | Compositions 8–14 | | | | | | |
|---|---|---|---|---|---|---|---|
| Component | 8 | 9 | 10 | 11 | 12 | 13 (WIPEOUT ®) | 14 (KITCHENSAFE ®) |
| SPC | 12.0 | 12.0 | — | — | 12.0 | | |
| APG | 15.0 | 15.0 | — | 15.0 | — | | |
| SPS | — | — | 12.0 | 12.0 | — | | |
| FAE | — | — | 15.0 | — | 15.0 | | |
| EB | 9.5 | 9.5 | 9.5 | 5.0 | 5.0 | | |
| PGP | 15.0 | 15.0 | 15.0 | 5.0 | 5.0 | | |
| PM | 10.0 | 10.0 | 10.0 | 5.0 | 5.0 | | |
| PNB | 3.0 | 3.0 | 3.0 | 5.0 | 5.0 | | |
| EDTA | — | — | — | — | — | | |
| NaC | 10.0 | — | — | — | — | | |
| NaP | — | 10.0 | — | — | — | | |
| Dye | — | — | .01 | — | .001 | | |
| FRG | — | — | — | .05 | .050 | | |
| $H_2O$ | 25.5 | 25.5 | 35.49 | 52.95 | 52.949 | | |

EB—Ethylene glycol n-butyl ether sold under the trademark DOWANOL® EB by Dow Chemical Company PM—Propylene glycol methyl ether sold under the trademark DOWANOL® PM by Dow Chemical Company PNB—Propylene glycol n-butyl ether sold under the trademark DOWANOL® PNB by Dow Chemical Company PGP—Propylene glycol propyl ether sold under the trademark DOWANOL® PNP by Dow Chemical Company EDTA—Ethylene diamine tetraacetic acid used in detergent systems as a builder NaC—Sodium carbonate used in detergent systems as a builder NaP—Sodium triphosphate used in detergent systems as a builder Composition 1 exemplifies the most preferred embodiment of the compositions of the present invention. Compositions 1 through 6 and 10 through 12, while containing high amounts of solvents and surfactants and no builders, were surprisingly found to be homogeneous, easily dispersible and provide excellent cleaning performance.

| | Stability (Compositions 1–7) | | | | | | |
|---|---|---|---|---|---|---|---|
| Composition | 1 | 2 | 3 | 4 | 5 | 6 | 7 |
| Stability | good | acc | acc | acc | good | good | unacc |

| Stability (Compositions 8–14) | | | | | | | |
|---|---|---|---|---|---|---|---|
| Composition | 8 | 9 | 10 | 11 | 12 | 13 | 14 |
| Stability | unacc | unacc | good | good | good | good | good |

Compositions 1 through 14 were evaluated for stability by placing approximately 100 grams of the composition into glass containers and thereafter storing the glass containers at room temperature or 120° F. for three days. The samples were then examined for signs of separation, sedimentation or other gross physical instabilities. Three ratings were assigned: good=stable at room temperature, stable at 120° F.; acceptable=stable at room temperature, unstable at 120° F.; unacceptable=unstable at room temperature.

Compositions 1, 5, 6 and 10 through 12 were found to have good stability and Compositions 2 through 4 were found to have acceptable stability. Compositions 7 through 9 which contain detergent builders were found to separate in solution and had unacceptable stability. Because Compositions 7 through 9 separated immediately, additional testing on them was not possible. compositions 13 and 14 which represent off-the-shelf prediluted products were found to have good stability.

| Soil Removal (Compositions 1–7) | | | | | | | |
|---|---|---|---|---|---|---|---|
| Composition | 1 | 2 | 3 | 4 | 5 | 6 | 7 |
| Soil Removal | 4.0 | 4.5 | 4.5 | 4.5 | 3.5 | 3.0 | NA |

| Soil Removal (Compositions 8–14) | | | | | | | |
|---|---|---|---|---|---|---|---|
| Composition | 8 | 9 | 10 | 11 | 12 | 13 | 14 |
| Soil Removal | NA | NA | 4.5 | 2.5 | 3.0 | 2.0 | 1.5 |

Compositions 1 through 6 and 10 through 14 were tested for soil removal by the following method: three solid circles approximately 1.5 inches in diameter were drawn across the white portion of an opacity chart (Leneta Corporation Form 5C) using a Sanford permanent marker. The compositions were then applied from a spray bottle onto each circle using three sprays per circle. The product was allowed to soak for 30 seconds and thereafter the three circles were scrubbed with a paper towel until no additional ink was removed, approximately 30 seconds. The chart was thereafter rinsed in running water and graded by an expert grader versus established standards where 1=no removal and 5=complete removal. Compositions 1 through 4 and Composition 10 were found to have superior removal abilities. Compositions 5, 6, 11 and 12 had good soil removal characteristics and Compositions 13 and 14 which represent off-the-shelf prediluted products had poor to good removal characteristics.

| Evaporation Rate (Compositions 1–7) | | | | | | | |
|---|---|---|---|---|---|---|---|
| Composition | 1 | 2 | 3 | 4 | 5 | 6 | 7 |
| Evaporation Rate | 2.1 | 3.1 | 2.1 | 2.2 | 2.5 | 2.8 | NA |

| Evaporation Rate (Compositions 8–14) | | | | | | | |
|---|---|---|---|---|---|---|---|
| Composition | 8 | 9 | 10 | 11 | 12 | 13 | 14 |
| Evaporation Rate | NA | NA | 2.5 | 2.4 | 3.9 | 3.2 | 2.6 |

Compositions 1 through 6 and 10 through 14 were evaluated for evaporation rate as follows: 2.5 grams of each composition was placed in an aluminum pan and thereafter the pan was placed in a Denver Moisture Balance Model IR100 at 107° C. Weight loss from the sample was monitored for six minutes. The total weight loss of the sample was divided by the weight loss observed for deionized water under the same conditions to yield the evaporation rate. Higher evaporation rates are preferred with rates about 2.0 or greater being acceptable for this application. The following evaporation rates were observed and compared to off-the-shelf highly diluted spray cleaning products with the results as follows. It was found that Compositions 1 through 6 and 10 through 12, even though containing high amounts of surfactants and solvents, had acceptable evaporation rates comparable to the off-the-shelf prediluted product.

| Streaking (Compositions 1–7) | | | | | | | |
|---|---|---|---|---|---|---|---|
| Composition | 1 | 2 | 3 | 4 | 5 | 6 | 7 |
| Streaking | 2 | 3 | 2 | 2 | 3 | 2 | NA |

| Streaking (Compositions 8–14) | | | | | | | |
|---|---|---|---|---|---|---|---|
| Composition | 8 | 9 | 10 | 11 | 12 | 13 | 14 |
| Streaking | NA | NA | 4 | 3 | 4 | 1 | 4 |

Compositions 1 through 6 and 10 through 14 were also evaluated for streaking. Four inch square glass plates were sprayed with two sprays of each composition and wiped dry with a paper towel. The glass plates were then graded by an expert grader in a light box as specified in ASTM D3556 85 test method for streaking and graded on a scale of 0=no streaks and 10=severe streaking. Compositions 1 through 6 and 10 through 12 showed good qualities of little streaking. Compositions 13 and 14 which are off-the-shelf prediluted compositions showed good qualities of little streaking.

| | Dilutions | | | | | | | |
|---|---|---|---|---|---|---|---|---|
| Composition 1 Dilutions | 1:0 | 1:1 | 1:2 | 1:5 | 1:10 | 1:20 | 1:50 | 0:1 |
| Streaking | 2 | 2 | 1 | 1 | 1 | 1 | 1 | 1 |
| Soil Removal | 4.0 | 2.5 | 2.0 | 1.5 | 1.5 | 1.5 | 1.0 | 1.0 |

Composition 1 was placed in dilute form in various ratios and thereafter again tested for streaking and soil removal in accordance with the above test methods. The benefits of cleaning with low streaking persist beyond the 1:20 dilution.

| | Flash Points (compositions 1–7) | | | | | | |
|---|---|---|---|---|---|---|---|
| Composition | 1 | 2 | 3 | 4 | 5 | 6 | 7 |
| Flash Points | 148 | 137 | 164 | 165 | 147 | 156 | NA |

| | Flash Points (Compositions 8–14) | | | | | | |
|---|---|---|---|---|---|---|---|
| Composition | 8 | 9 | 10 | 11 | 12 | 13 | 14 |
| Flash Points | NA | NA | 139 | 141 | 160 | 110 | 145 |

Flash points were measured with a SetaFlash flash point apparatus as described in the apparatus's accompanying instructions. Compositions 1 through 6 and 10 through 12 show acceptable product flash points greater than that of the highly dilute product 13.

It should be understood that a wide range of changes, modifications and equivalents could be made to the embodiments described above. It is therefore intended that the above descriptions illustrate, rather than limit, the invention and that it is the following claims, including all equivalents, which define the compositions and methods of use of the compositions of the present invention.

What is claimed is:

1. A method for cleaning a hard surface with an all-purpose liquid cleaning composition comprising the steps of:

1) providing a concentrated all-purpose homogeneous liquid cleaning composition free of builder salts consisting essentially of:
   (a) from about 1% to about 20% of at least one anionic surfactant selected from the group consisting of alkyl ethoxy sulfates, alkyl ethoxy carboxylates and mixtures thereof;
   (b) from about 1% to about 20% of at least one nonionic surfactant selected from the group consisting of fatty alcohol ethoxylates, nonylphenol ethoxylates, alkylpolyglycosides and mixtures thereof; and,
   (c) from about 20% to about 60% of a solvent selected from the group consisting of water-soluble glycol ethers and mixtures thereof;
2) applying said liquid cleaning composition to the surface to be cleaned and;
3) wiping from said surface said liquid cleaning composition.

2. The method for cleaning hard surfaces of claim 1 wherein the anionic surfactant is sodium $C_{12}$–$C_{15}$ pareth-7 carboxylate.

3. The method for cleaning hard surfaces of claim 1 wherein said nonionic surfactant is an alkylpolyglycoside having a $C_9$–$C_{10}$ alkyl group with an average carbohydrate unit per molecule of 1.5 to 2.7.

4. The method of cleaning hard surfaces of claim 1 wherein said solvent is selected from the group consisting of ethylene glycol n-butyl ether, propylene glycol methyl ether, propylene glycol propyl ether, propylene glycol n-butyl ether and mixtures thereof.

5. A method for cleaning a hard surface with an all-purpose liquid cleaning composition comprising the steps of:

a. providing a concentrated all-purpose homogeneous liquid cleaning composition free of builder salts consisting essentially of:
   i. from about 1% to about 20% of at least one anionic surfactant selected from the group consisting of alkyl ethoxy sulfates, alkyl ethoxy carboxylates and mixtures thereof;
   ii. from about 1% to about 20% of at least one nonionic surfactant selected from the group consisting of fatty alcohol ethoxylates, nonylphenol ethoxylates, alkylpolyglycosides and mixtures thereof; and
   iii. from about 20% to about 60% of a solvent selected from the group consisting of water-soluble glycol ethers and mixtures thereof;
b. diluting the concentrated cleaning composition with water in a ratio of concentrated cleaning composition to water from about 1:1 to about 1:20;
c. applying the diluted liquid cleaning composition to the surface to be cleaned and;
d. wiping from the surface the liquid cleaning composition.

6. The method of cleaning hard surfaces of claim 5 wherein the anionic surfactant is sodium $C_{12}$–$C_{15}$ pareth-7 carboxylate.

7. The method of cleaning hard surfaces of claim 6 wherein the nonionic surfactant is an alkylpolyglycoside having a $C_9$–$C_{10}$ alkyl group with an average carbohydrate unit per molecule of 1.5 to 2.7.

8. The method of cleaning hard surfaces of claim 5 wherein the solvent is selected from the group consisting of ethylene glycol n-butyl ether, propylene glycol methyl ether, propylene glycol propyl ether, propylene glycol n-butyl ether and mixtures thereof.

* * * * *